US006909667B2

(12) United States Patent
Shah et al.

(10) Patent No.: US 6,909,667 B2
(45) Date of Patent: Jun. 21, 2005

(54) DUAL CHANNEL DOWNHOLE TELEMETRY

(75) Inventors: Vimal V. Shah, Sugar Land, TX (US); Wallace R. Gardner, Houston, TX (US); Paul F. Rodney, Spring, TX (US); James H. Dudley, Spring, TX (US); M. Douglas McGregor, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 377 days.

(21) Appl. No.: 10/075,529

(22) Filed: Feb. 13, 2002

(65) Prior Publication Data

US 2003/0151977 A1 Aug. 14, 2003

(51) Int. Cl.[7] ..... H04H 9/00

(52) U.S. Cl. ..... 367/83; 340/854.3; 340/854.4; 340/854.6

(58) Field of Search ..... 340/854.6, 853.3, 340/854.3, 854.4; 367/81, 82, 83

(56) References Cited

U.S. PATENT DOCUMENTS

| | | | | |
|---|---|---|---|---|
| 3,590,228 A | | 6/1971 | Burke | 235/151.35 |
| 4,057,781 A | | 11/1977 | Scherbatskoy | 340/18 LD |
| 4,066,995 A | | 1/1978 | Matthews | 340/18 LD |
| 4,293,937 A | | 10/1981 | Sharp et al. | 367/82 |
| 4,823,125 A | | 4/1989 | Rorden et al. | 340/854 |
| 4,908,804 A | | 3/1990 | Rorden | 367/81 |
| 4,945,761 A | | 8/1990 | Lessi et al. | 73/151 |
| 5,096,001 A | | 3/1992 | Buytaert et al. | 175/40 |
| 5,128,901 A | | 7/1992 | Drumheller | 367/82 |
| 5,160,925 A | * | 11/1992 | Dailey et al. | 340/853.3 |
| 5,546,359 A | | 8/1996 | Aarseth | 367/134 |
| 5,581,024 A | | 12/1996 | Meyer, Jr. et al. | 73/152.03 |
| 5,586,083 A | | 12/1996 | Chin et al. | 367/84 |
| 5,639,997 A | | 6/1997 | Mallett | 181/102 |
| 5,798,488 A | | 8/1998 | Beresford et al. | 181/102 |
| 5,812,068 A | | 9/1998 | Wisler et al. | 340/355.5 |
| 5,881,310 A | | 3/1999 | Airhart et al. | 395/823 |
| 5,886,303 A | | 3/1999 | Rodney | 181/102 |
| 6,023,164 A | | 2/2000 | Prammer | 324/303 |
| 6,023,658 A | | 2/2000 | Jeffryes | 702/16 |
| 6,088,294 A | | 7/2000 | Leggett, III et al. | 367/25 |
| 6,144,316 A | * | 11/2000 | Skinner | 340/853.7 |

FOREIGN PATENT DOCUMENTS

| | | | |
|---|---|---|---|
| EP | 0 919 697 | 6/1999 | E21B/47/12 |
| GB | 2 333 785 | 8/1999 | E21B/47/16 |
| GB | 2 344 896 | 6/2000 | E21B/47/12 |

OTHER PUBLICATIONS

PCT International Search Report dated Oct. 10, 2003 for PCT/US03/04427.

* cited by examiner

*Primary Examiner*—Timothy Edwards, Jr.
(74) *Attorney, Agent, or Firm*—Conley Rose, P.C.; Michael W. Piper

(57) ABSTRACT

The present disclosure provides several methods for selecting and transmitting information from downhole using more than one channel of communication wherein data streams transmitted up each communications channel are each independently interpretable without reference to data provided up the other of the communications channels. Preferred embodiments incorporate the use of a combination of at least two of mud-based telemetry, tubular-based telemetry, and electromagnetic telemetry to achieve improved results and take advantage of opportunities presented by the differences between the different channels of communication.

54 Claims, 1 Drawing Sheet

DUAL CHANNEL DOWNHOLE TELEMETRY

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates generally to a telemetry system for transmitting data from a downhole drilling assembly to the surface of a well during drilling operations. More particularly, the present invention relates generally to methods for transmitting downhole measurements to the surface of the well through separate channels or media.

2. Description of the Related Art

The recovery of subterranean hydrocarbons, such as oil and gas, usually requires drilling boreholes thousands of feet deep. In addition to an oil rig on the surface, drilling string tubing extends downward through the borehole to hydrocarbon formations. The borehole may also be drilled to include horizontal, or lateral bores. As a result, modern petroleum drilling operations demand a great quantity of information relating to parameters and conditions downhole. Such information typically includes characteristics of the earth formations traversed by the wellbore, in addition to data relating to the size and configuration of the borehole itself. The collection of information relating to conditions downhole, which commonly is referred to as "logging," can be performed by several methods. Oil well logging has been known in the industry for many years as a technique for providing information to a driller regarding the particular earth formation being drilled. In conventional oil well wireline logging, a probe or "sonde" housing formation sensors is lowered into the borehole after some or all of the well has been drilled, and is used to determine certain characteristics of the formations traversed by the borehole. The sonde is supported by an electrically conductive wireline, which attaches to the sonde at the upper end. Power is transmitted to the sensors and instrumentation in the sonde through the conductive wireline. Similarly, the instrumentation in the sonde communicates information to the surface by electrical signals transmitted through the wireline.

One of the problems with obtaining downhole measurements via wireline is that the drilling assembly must be removed or "tripped" from the drilled borehole before the desired borehole information can be obtained. This can be both time-consuming and extremely costly, especially in situations where a substantial portion of the well has been drilled. In this situation, thousands of feet of tubing may need to be removed and stacked on the platform (if offshore). Typically, drilling rigs are rented by the day at a substantial cost. Consequently, the cost of drilling a well is directly proportional to the time required to complete the drilling process. Removing thousands of feet of tubing to insert a wireline logging tool can be an expensive proposition. In addition to the desire to get data during drilling to avoid the complexities of obtaining downhole measurements by stopping drilling, data obtained while drilling has intrinsic value for safety, drilling decisions (such as where to set casing, and remaining on target within a formation), and quality control.

As a result, there has been an increased emphasis on the collection of data during the drilling process. By collecting and processing data during the drilling process, without the necessity of removing or tripping the drilling assembly to insert a wireline logging tool, the driller can make accurate modifications or corrections, as necessary, to optimize performance while minimizing down time. Techniques for measuring conditions downhole and the movement and location of the drilling assembly, contemporaneously with the drilling of the well, have come to be known as "measurement-while-drilling" techniques, or "MWD." Similar techniques, concentrating more on the measurement of formation parameters, commonly have been referred to as "logging while drilling" techniques, or "LWD." While distinctions between MWD and LWD may exist, the terms MWD and LWD often are used interchangeably. For the purposes of this disclosure, the term MWD will be used with the understanding that this term encompasses both the collection of formation parameters and the collection of information relating to the movement and position of the drilling assembly.

Drilling oil and gas wells is carried out by means of a string of drill pipes connected together so as to form a drill string. Connected to the lower end of the drill string is a drill bit. The bit is rotated and drilling accomplished by either rotating the drill string, or by use of a downhole motor near the drill bit, or by both methods. Drilling fluid, termed mud, is pumped down through the drill string at high pressures and volumes (such as 3000 p.s.i. at flow rates of up to 1400 gallons per minute) to emerge through nozzles or jets in the drill bit. The mud then travels back up the hole via the annulus formed between the exterior of the drill string and the wall of the borehole. On the surface, the drilling mud is cleaned and then recirculated. The drilling mud is used to cool and lubricate the drill bit, to carry cuttings from the base of the bore to the surface, and to balance the hydrostatic pressure in the rock formations.

When oil wells or other boreholes are being drilled, it is frequently necessary or desirable to determine the direction and inclination of the drill bit and downhole motor so that the assembly can be steered in the correct direction. Additionally, information may be required concerning the nature of the strata being drilled, such as the formation's resistivity, porosity, density and its measure of gamma radiation. It is also frequently desirable to know other downhole parameters. Examples of this are the temperature and the pressure at the base of the borehole. Once the data is gathered at the bottom of the borehole, it is typically transmitted to the surface for use and analysis by the driller.

In MWD systems sensors or transducers typically are located at the lower end of the drill string which, while drilling is in progress, continuously or intermittently monitor predetermined drilling parameters and formation data and transmit the information to a surface detector by some form of telemetry. Typically, the downhole sensors employed in MWD applications are positioned in a cylindrical drill collar that is positioned close to the drill bit. The MWD system then employs a system of telemetry in which the data acquired by the sensors is transmitted to a receiver located on the surface.

There are a number of telemetry systems in the prior art which seek to transmit information regarding downhole parameters (downhole telemetry data) up to the surface without requiring the use of a wireline tool. Linking downhole instrumentation to the surface with wiring has proven exceedingly expensive and unreliable due to operational constraints such as making up pipe joints (requiring a separate connection to the link for each joint), operational hazards, and the corrosive fluids and high ambient temperatures often found in the well.

Electromagnetic radiation has been utilized to telemeter data from downhole to the surface (and vice-versa). In these systems, a current is either induced on the drill string from a downhole transmitter, or an electrical potential is impressed across an insulated gap in a downhole portion of the drill string. Information is transmitted from downhole by modulating this current or voltage, and is detected at the surface with electric field and or magnetic field sensors. In a preferred embodiment, information is transmitted by phase shifting a carrier wave among a number of discrete phase states. Although the drill pipe acts as part of the conductive path, system losses are almost always dominated by conduction losses within the earth, which also carries the electromagnetic radiation. These systems work well in regions where the earth's conductivity between the telemetry transmitter and the earth's surface is consistently low. As a rule of thumb, the conductive losses through a homogeneous section of the earth vary as $$e^{-\sqrt{\frac{2\pi\cdot f\mu\sigma}{2}}z}$$

where f is the frequency of the radiation in Hz, $\mu$ is the magnetic permeability of the medium through which the field propagates (typically, $\mu=4\cdot\pi\cdot10^{-7}$ henrys/meter), $\sigma$ is the conductivity of the medium (typically, $0.0005<\sigma<10$ mhos/meter and varies considerably between the transmitter and the earth's surface). If such a system is to be used in the presence of high conductivities, even for a portion of the telemetry path, it is necessary to restrict f to very low values, on the order of 1 Hz, in order to reduce signal loss to an acceptable level. Where the conductivity is favorable, it is possible to exceed mud pulse telemetry rates with these systems, and it may be possible to rival the rates achievable with acoustic telemetry systems. Such low conductivity regions constitute a small segment of the wells needing telemetry while drilling. Representative examples of electromagnetic telemetry systems may be found in U.S. Pat. Nos. 4,302,757, 4,525,715, and 4,691,203. U.S. Pat. Nos. 6,075,462 and 6,160,492, the disclosures of which are incorporated herein by reference, discuss electromagnetic telemetry in general and a preferred electromagnetic telemetry device in detail.

More common is the practice of transmitting data using pressure waves in drilling fluids such as drilling mud, or mud pulse/mud siren telemetry. The mud pulse system of telemetry creates acoustic and pressure signals in the drilling fluid that is circulated under pressure through the drill string during drilling operations. The information that is acquired by the downhole sensors is transmitted by suitably timing the formation of pressure pulses in the mud stream. The information is received and decoded by a pressure transducer and computer at the surface.

In a mud pressure pulse system, the drilling mud pressure in the drill string is modulated by means of a valve and control mechanism, generally termed a pulser or mud pulser. The pulser is usually mounted in a specially adapted drill collar positioned above the drill bit. The generated pressure pulse travels up the mud column inside the drill string at the velocity of sound in the mud. Depending on the type of drilling fluid used, the velocity may vary between approximately 3000 and 5000 feet per second. The rate of transmission of data, however, is relatively slow due to pulse spreading, distortion, attenuation, modulation rate limitations, and other disruptive forces, such as the ambient noise in the transmission channel. A typical pulse rate is on the order of a pulse per second (1 Hz). The preferred embodiment uses pulse position modulation to transmit data. In pulse position modulation, all of the pulses have a fixed width, and the interval between pulses is proportional to the data value transmitted. The primary method of increasing the data rate of the transmitted signal is to increase the mean frequency f of the pulses. As the frequency f of the pulses increases, however, it becomes more and more difficult to distinguish between adjacent pulses because the resolution period is too short. The problem is that the period T for each individual pulse has decreased proportionately (T=1/f). The resolution therefore decreases, causing problems with detection of the adjacent pulses at the surface. A more important problem than inter-symbol interference caused by decreased period is the fact that the attenuation of mud pulses increases significantly with frequency so that as one attempts to increase the data rate, less signal is available at the surface. A situation rapidly develops in which the signal cannot be detected as one attempts to increase the data rate. Representative examples of mud pulse telemetry systems may be found in U.S. Pat. Nos. 3,949,354, 3,958,217, 4,216,536, 4,401,134, and 4,515,225. U.S. Pat. No. 5,586,084, the disclosure of which is incorporated herein by reference, discusses mud pulsers in general and a preferred mud pulser in detail.

Mud pressure pulses can be generated by opening and closing a valve near the bottom of the drill string so as to momentarily restrict the mud flow. In a number of known MWD tools, a "negative" pressure pulse is created in the fluid by temporarily opening a valve in the drill collar so that some of the drilling fluid will bypass the bit, the open valve allowing direct communication between the high pressure fluid inside the drill string and the fluid at lower pressure returning to the surface via the exterior of the string. Alternatively, a "positive" pressure pulse can be created by temporarily restricting the downward flow of drilling fluid by partially blocking the fluid path in the drill string.

Both the positive and negative mud pulse systems typically generate base band signals. In an attempt to increase the data rate and reliability of the mud pulse signal, other techniques also have been developed as an alternative to the positive or negative pressure pulses generated. One early system is that disclosed in U.S. Pat. No. 3,309,656, which used a downhole pressure pulse generator or modulator to transmit modulated signals, carrying encoded data, at acoustic frequencies to the surface through the drilling fluid or drilling mud in the drill string. In this and similar types of systems, the downhole electrical components are powered by a downhole turbine generator unit, usually located downstream of the modulator unit, that is driven by the flow of drilling fluid. These types of devices typically are referred to as mud sirens. Other examples of such devices may be found in U.S. Pat. Nos. 3,792,429, 4,785,300 and Re. 29,734. U.S. Pat. No. 5,586,083, the disclosure of which is incorporated herein by reference, discusses mud sirens in general and a preferred mud siren in detail.

Telemetry utilizing acoustic transmitters in the pipe string has emerged as a potential method to increase the speed and reliability of data transmission from downhole to the surface. When actuated by a signal such as a voltage potential from a sensor, an acoustic transmitter mechanically mounted on the tubing imparts a stress wave or acoustic pulse onto the tubing string. Because metal pipe propagates stress waves more effectively than drilling fluids, acoustic transmitters used in this configuration have been shown to transmit data in excess of 10 BPS (bits per second). Furthermore, such acoustic transmitters can be used during all aspects of well site development regardless of whether drilling fluids are present. Examples of acoustic transmitters include the disclosures of U.S. Pat. Nos. 5,703,836, 5,222,049, and 4,992,997. U.S. Pat. No. 6,137,747, the disclosure of which is incorporated herein by reference, discusses acoustic transmitters in general and a preferred acoustic transmitter for transmission through the drill string in detail. While acoustic telemetry through the drill string has been a project for many years, commercial success, even during non-drilling conditions, has only relatively recently been obtained. Additionally, while several patents and publications provide suggestions for such telemetry while drilling (see for example U.S. Pat. No. 3,588,804 to Fort, U.S. Pat. No. 4,320,473 to Smither and Vela, and SPE paper 8340 from 1979 authored by Squire and Whitehouse and titled "A new approach to drill-string acoustic telemetry"), a full commercially successful embodiment providing commercially desirable bandwidths has not yet been marketed. The presence of less reliable and at best narrower bandwidth options for acoustic telemetry through the drill string support the need for the method of the present application to address how best to optimize use of current and pending developments in this area.

SUMMARY OF THE INVENTION

The present disclosure addresses methods for communicating data in a wellbore having a drill string forming a tubular communications channel and through which drilling mud flows during drilling operations forming a mud communications channel and wherein the earth forms an electromagnetic communications channel. These channels are present whether or not they are actually used by transmitters designed for that purpose. The most preferred embodiment includes using a first telemetry transmitter coupled to the drill string to transmit a first data stream through a first communications channel. In the same embodiment a second telemetry transmitter coupled to the drill string is used to transmit a second data stream through a second communications channel. Both the first data stream and the second data stream are independently interpretable without reference to data provided up the other of the communications channels. In one embodiment the two data streams are transmitted simultaneously, while in an alternative embodiment the two channels are not used at the same time. A further embodiment may use a third telemetry transmitter to transmit a third stream of data up a third communications channel. This third transmitter may be operated simultaneously with the other two transmitters or simultaneously with one but not at the same time as the other. Transmitters may include mud-based acoustic telemetry devices, tubular-based acoustic telemetry devices, and electromagnetic telemetry devices communicating up the mud channel, the tubular channel, and the electromagnetic channel respectively.

BRIEF DESCRIPTION OF THE DRAWINGS

For a more detailed description of the preferred embodiment of the present invention, reference will now be made to the accompanying drawings, wherein.

Figure 1:
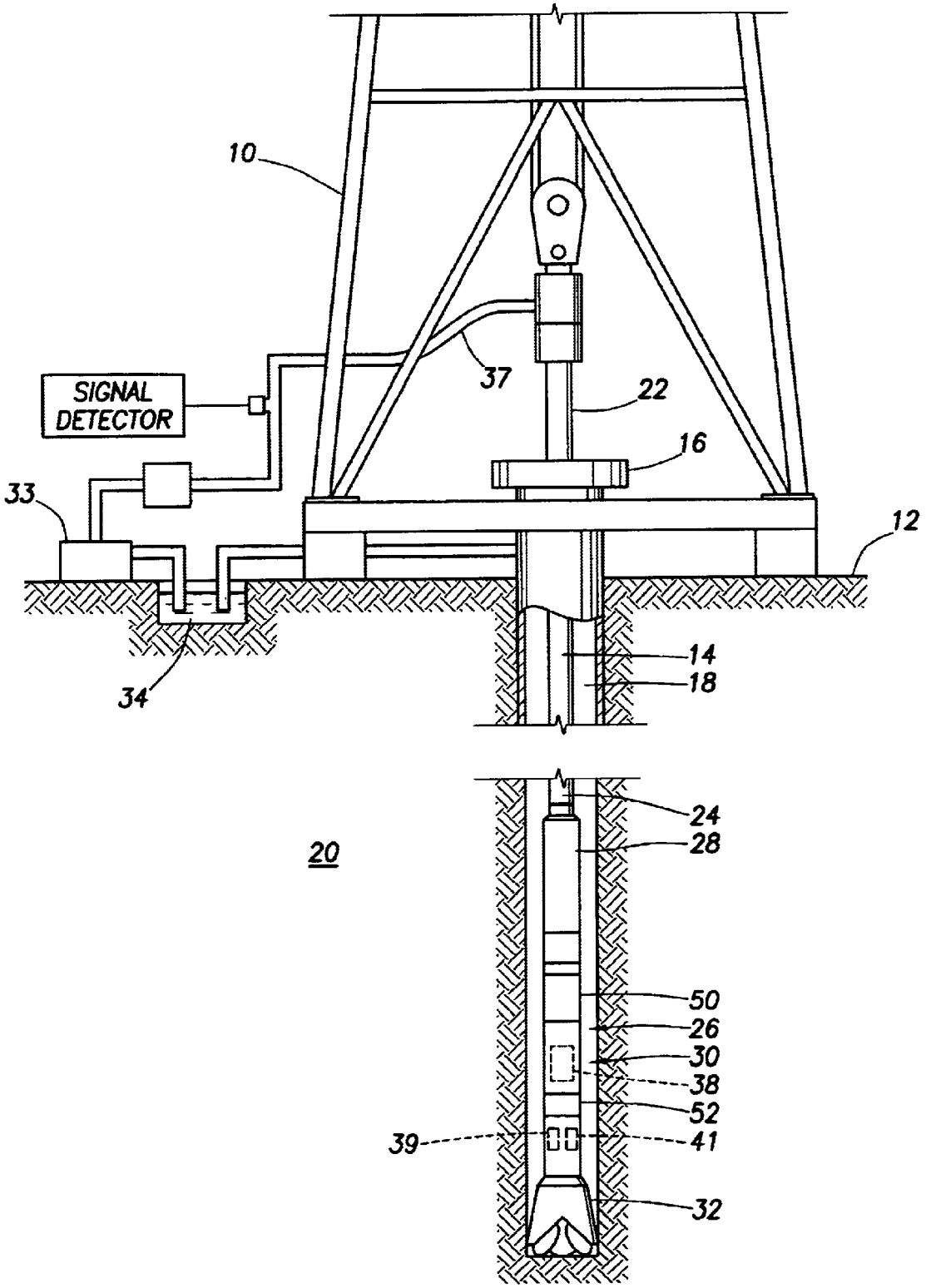
FIG. 1 is a schematic view of a drilling system and its environment.

During the course of the following description, the terms "upstream" and "downstream" are used to denote the relative position of certain components with respect to the direction of flow of the drilling mud. Thus, where a term is described as upstream from another, it is intended to mean that drilling mud flows first through the first component before flowing through the second component. Similarly, the terms such as "above," "upper" and "below" are used to identify the relative position of components in the bottom hole assembly, with respect to the distance to the surface of the well, measured along the borehole path.

DETAILED DESCRIPTION OF THE PREFERRED EMBODIMENT

Referring now to FIG. 1, a typical drilling installation is illustrated which includes a drilling rig 10, constructed at the surface 12 of the well, supporting a drill string 14. The drill string 14 penetrates through a rotary table 16 and into a borehole 18 that is being drilled through earth formations 20. The drill string 14 includes a Kelly 22 at its upper end, drill pipe 24 coupled to the Kelly 22, and a bottom hole assembly 26 (commonly referred to as a "BHA") coupled to the lower end of the drill pipe 24. The BHA 26 typically includes drill collars 28, a MWD tool 30, and a drill bit 32 for penetrating through earth formations to create the borehole 18. In operation, the Kelly 22, the drill pipe 24 and the BHA 26 are rotated by the rotary table 16. Alternatively, or in addition to the rotation of the drill pipe 24 by the rotary table 16, the BHA 26 may also be rotated, as will be understood by one skilled in the art, by a downhole motor. The drill collars are used, in accordance with conventional techniques, to add weight to the drill bit 32 and to stiffen the BHA 26, thereby enabling the BHA 26 to transmit weight to the drill bit 32 without buckling. The weight applied through the drill collars to the bit 32 permits the drill bit to crush and make cuttings in the underground formations.

As shown in FIG. 1, the BHA 26 preferably includes a measurement while drilling system (referred to herein as "MWD") tool 30, which may be considered part of the drill collar section 28. As the drill bit 32 operates, substantial quantities of drilling fluid (commonly referred to as "drilling mud") are pumped by a mud pump 33 from a mud pit 34 at the surface through the Kelly hose 37, into the drill pipe 24, to the drill bit 32. The drilling mud is discharged from the drill bit 32 and functions to cool and lubricate the drill bit, and to carry away earth cuttings made by the bit. After flowing through the drill bit 32, the drilling fluid rises back to the surface through the annular area between the drill pipe 24 and the borehole 18, where it is collected and returned to the mud pit 34 for filtering.

In the preferred embodiment, the MWD tool 30 includes one or more condition responsive sensors 39 and 41, which are coupled to appropriate data encoding circuitry, such as an encoder 38, which sequentially produces encoded digital data electrical signals representative of the measurements obtained by sensors 39 and 41. While two sensors are shown, one skilled in the art will understand that a smaller or larger number of sensors may be used without departing from the principles of the present invention. The sensors are selected and adapted as required for the particular drilling operation, to measure such downhole parameters as the downhole pressure, the temperature, the resistivity or conductivity of the drilling mud or earth formations, and the density and porosity of the earth formations, as well as to measure various other downhole conditions according to known techniques. See generally "State of the Art in MWD," International MWD Society (Jan. 19, 1993).

The circulating column of drilling mud flowing through the drill string may also function as a medium for transmitting pressure pulse acoustic wave signals, carrying information from the MWD tool 30 to the surface. The use of drilling mud as a medium for acoustic communication will be referred to hereinafter as mud-based telemetry and the communication channel defined for such telemetry will be referred to hereinafter as the mud channel. As discussed above, several devices are known in the art for use in communicating using the mud channel. Collectively, these will be referred to herein as mud-based telemetry devices. Two major subsets are mud pulsers and mud sirens, again as described above and understood by those of skill in the art. These devices typically function on a single channel (although multiple channels are possible, for example one stream of communication based on positive pressure pulses and an independent second stream based on negative pressure pulses, but both traveling through the same medium) and currently transmit data in the field at the rate of about 1–3 bits per second. In labs such devices currently transmit data at the rate of about 8–15 bits per second and in theory such devices could transmit data at the rate of 15–20 bits per second.

Additionally, the drill string itself (the drill pipe 24 and components connecting and bridging stands of drill pipe on the way back to the surface) may also function as a medium for transmitting acoustic wave signals, carrying information from the MWD tool 30 to the surface. Preferably, the waves are stress waves traveling in the metallic acoustic transmission medium of the tubulars. The use of the drill string itself as a medium for acoustic communication will be referred to hereinafter as tubular-based telemetry and the communication channel defined for such telemetry will be referred to hereinafter as the tubular channel. These devices can function on multiple channels, but through the same medium. For the purposes of this disclosure, communications through the same medium will be referred to as communications through the channel for that medium. Tubular-based telemetry devices currently transmit data in the field at the rate of about 6–10 bits per second. In labs such devices currently transmit data at the rate of about 6–16 bits per second and in theory such devices could transmit data at the rate of 100 bits per second per channel within the medium. One example of such a device comprises the use of a piezoelectric stack to send stress-waves through the metallic acoustic transmission medium of the tubulars. An alternative example of such a device comprises the use of a magnetostrictive element to send stress-waves through the metallic acoustic transmission medium of the tubulars.

Both mud-based telemetry systems and tubular-based telemetry systems can be conceived of as acoustic telemetry systems. In these systems, electrical signals are converted to acoustic waves (either in the form of pressure pulses up the mud channel or stress waves up the tubular channel). The receivers at the surface are similarly acoustic transducers, converting the acoustic waves back into electrical signals. The acoustic transducers which send the signal back to the surface are referred to as acoustic transmitters. The acoustic transducers which receive the signal at the surface are referred to as acoustic receivers. For the purposes of this disclosure, an acoustic transducer includes both a mud-based telemetry device and a tubular-based telemetry device.

Although not specifically illustrated, in addition to the acoustic methods of telemetry (tubular-based telemetry and mud-based telemetry), electromagnetic methods of telemetry may also be used as discussed above. In this case the earth functions as a medium for transmitting electromagnetic wave signals, carrying information from the MWD tool 30 to the surface. For this embodiment, an electromagnetic telemetry device could also be integrated into the MWD tool 30, either instead of one of the acoustic telemetry devices or in addition to the acoustic telemetry devices. The waves travel through the earth, and in part through the drill string, casing, or other artifacts which are present in the earth and which, for the purposes of this disclosure, are collectively referred to as the earth. The use of the earth as a medium for electromagnetic communication will be referred to hereinafter as electromagnetic telemetry and the communication channel defined for such telemetry will be referred to hereinafter as the electromagnetic channel. These devices can function on multiple channels, but through the same medium. Electromagnetic telemetry devices currently transmit data in the field at the rate of about 3–5 bits per second. In labs such devices currently transmit data at the rate of about 50 bits per second and in theory such devices could transmit data at the rate of 50 bits per second per channel within the medium.

An electromagnetic telemetry system typically employs electromagnetic transmitters and electromagnetic receivers which transmit and receive electromagnetic waves (also referred to as electromagnetic radiation). For purposes of this disclosure, acoustic transmitters and electromagnetic transmitters will collectively be referred to as telemetry transmitters; acoustic receivers and electromagnetic receivers will collectively be referred to as telemetry receivers; and acoustic telemetry devices and electromagnetic telemetry devices will collectively be referred to as telemetry devices.

In the preferred embodiment, the MWD tool 30 includes both a tubular-based telemetry device 50 and a mud-based telemetry device 52. Stated another way, the MWD tool 30 includes an acoustic transducer which transmits data using the tubular channel and a separate acoustic transducer which transmits data using the mud channel. When the separate transducers are referred to as both being included in the MWD tool, this does not require that they be connected to one another or even that there only be other elements of the tool between the transducers. In this disclosure the presence in the same tool indicates only that the transducers are coupled to one another either by direct connection or indirectly by other components of the tool or by the drill string itself. In fact, all of the elements of the MWD tool are typically coupled to the drill string. The separate transducers are placed into the borehole together when the drill string is sent into the borehole and are removed from the borehole together if the drill string is removed. By being part of the same functional tool, either, both, or neither transducers may be used without the need to remove the drill string or the need to send down a coiled tubing or wireline device or otherwise remove or send additional elements down the borehole. In alternative embodiments, the MWD tool 30 could include both an acoustic telemetry device (such as a tubular-based telemetry device 50 or a mud-based telemetry device 52) and an electromagnetic telemetry device or could include more than one acoustic telemetry device (such as both a tubular-based telemetry device 50 and a mud-based telemetry device 52) and an electromagnetic telemetry device.

The MWD tool 30 preferably is located as close to the bit 32 as practical. In the most preferred orientation tubular-based telemetry device 50 is located upstream of mud-based telemetry device 52 which is upstream of sensors 39 and 41. While this is the preferred alignment, the alignment could be modified in any number of ways recognized by one of skill in the art. The sensors particularly may be placed in different locations as is most appropriate to most accurately or reliably sense the attributes they are respectively targeted for. As discussed above, two sensors are used as an example but any number of sensors may be used to detect different attributes or properties.

The acoustic transmitters are selectively operated in response to the data encoded electrical output of the encoder 38 to generate a corresponding encoded acoustic wave signal. With multiple acoustic transmitters, there could either be a separate encoder 38 for each transducer or alternatively, a single encoder 38 with multiple outputs with an output for each transmitter. This acoustic signal is transmitted to the well surface through the medium of the specific transducer as a series of acoustic signals in the form of pressure pulses or stress waves, which preferably are encoded binary representations of measurement data indicative of the downhole drilling parameters and formation characteristics measured by sensors 39 and 41. These binary representations preferably are made through the use of modulation techniques on a carrier acoustic wave, including amplitude, frequency or phase-shift modulation. The presence or absence of modulation in a particular interval or transmission bit preferably is used to indicate a binary "0" or a binary "1" in accordance with conventional techniques. When these pressure pulse signals are received at the surface, they are detected, decoded and converted into meaningful data by a conventional acoustic signal detector (not shown). Electromagnetic transmitters could similarly operate to generate electromagnetic wave signals in response to output from a separate encoder 38 or from one of multiple outputs of a single encoder 38.

Signals representing measurements taken by the various sensors are generated and may be stored in the MWD tool 30. More commonly, especially where contemporaneous transmission is difficult or unreliable, data from the various sensors may be stored in the MWD tool 30 in a digital form. Signals are then generated from the stored data by the encoder 38 prior to transmission. Some or all of the signals also may be routed through one of the communication channels to acoustic receivers coupled to the relevant channel at or near the earth's surface 12, where the signals are processed and analyzed.

The acoustic signals generated by the transducers typically are in the form of sine waves or discrete pulses. One possible technique is to implement frequency modulation (also referred to as frequency shift keying or "FSK"). Typically, the transmission of acoustic signals is divided into a plurality of intervals (each of which has a uniform duration of, for example, one second). The presence of a 600 Hz signal (as opposed to a 1000 Hz signal, for example) during a particular transmission interval or "bit" could signify either a digital "0" or a digital "1" as desired. Alternatively, three or more distinct frequency levels could be used to encode the data in one of three ways to increase the rate at which data can be transmitted. Another technique that can be implemented with the present invention is to encode downhole information on the carrier signal through the use of amplitude modulation. Still another technique that may be used to encode information on the carrier signal is to phase shift (also referred to as phase shift keying or "PSK") the acoustic signal. In phase-shift keying with continuous sine waves, the change in phase could be coded as a binary "1," while the absence of a change in phase could represent a binary "0." As one skilled in the art will understand, other modulation techniques, including quadrature amplitude modulation (QAM), also may be used in addition to those disclosed to encode downhole information on the carrier signal.

To increase data rate, the carrier signal may be modulated using various combinations of modulation techniques. Thus, for example, both frequency modulation and amplitude modulation may be used to increase the amount of information that can be transmitted in each interval (or transmission bit). The use of two forms of modulation (each of which has two states) effectively doubles the data rate by providing four possible values ($2^2$=4) for each interval, instead of only two possible values for the interval.

The transmission of information from downhole in a drilling environment poses interesting challenges and choices. Traditionally, the use of mud-based telemetry devices has been the most reliable way to communicate information from downhole. However, mud-based telemetry devices provide a relatively narrow bandwidth of information (both practically and theoretically) and there is significantly more information which could be desirable on a real-time or near real-time basis. Additionally, mud-based telemetry devices only operate when mud is flowing. Mud flows during drilling itself, and can even flow when not drilling, but during the drilling process there are times when both drilling and mud flow are stopped. For example, a new stand is added to the drill string somewhere between every 15 to 30 minutes for relatively soft formations to every hour or more for hard or more difficult formations. The absence of drilling activity reduces the noise downhole, providing an opportunity for significantly improved bandwidth on any channel, while at the same time removing from availability one of the most reliable channels of communication.

Tubular-based telemetry is, by comparison, only relatively recently become successfully used in a commercial manner. While offering the opportunity for significantly higher bandwidths, the channel is also much less reliable, in part because of the intense and not always predictable noise generated by the drilling process itself, but also by the challenges of accurately receiving and filtering a signal which is passing through a medium with a series of somewhat unpredictable discontinuities at the junctions between each individual pipe headed up the drill string. On the other hand, transmission up through the tubing is not limited to the time when the mud is flowing, and also achieves higher and more reliable bandwidths when performed in the absence of active drilling activity. Another approach to the use of transmission through the tubing is to use a variable data rate, one while drilling and another while not drilling. Similarly, as discussed in the background, one of the goals in tubular-based telemetry is to seek and use different pass bands or frequency ranges with lower attenuations. The presence or absence of active drilling may call for the use of different pass bands for the different conditions. Additionally, the absence of active drilling may allow for the use of a greater number of pass bands, hence providing a greater potential bandwidth for communication.

Like the tubular-based telemetry systems, electromagnetic telemetry systems are currently perceived as less reliable, but have recently made substantial strides, particularly in certain favorable structures. Also like the tubular-based systems, electromagnetic telemetry is able to function in situations where mud-based telemetry can not, for example when mud is not flowing or in underbalanced drilling environments (such as drilling with foams) where the lower density drilling fluids either have greatly reduced bandwidth or none at all for mud-based telemetry. Electromagnetic telemetry systems find application in regions of consistently low conductivity, foam drilling applications (where mud pulse telemetry systems are of little use), and in systems requiring telemetry when the mud pumps are not operating. Electromagnetic telemetry could be used to advantage when combined with mud-based or tubular-based telemetry. In many cases, especially with mud-based telemetry, it could effectively double the data rate.

The present disclosure provides several methods for selecting and transmitting information from downhole using a combination of mud-based telemetry, tubular-based telemetry, and electromagnetic telemetry to achieve improved results and take advantage of opportunities presented by the differences between the different channels of communication.

Alternating Channels Method

A first method addresses the issue of how to transmit information more reliably and consistently and at a higher combined effective data rate during the drilling process. Data is transmitted from downhole by mud-based telemetry during the process of active drilling, and can also be transmitted by mud-based telemetry while pausing during drilling, so long as the mud flow is maintained. However, circumstances arise in which it is desirable to stop the flow of mud, but still receive data without sending down an additional tool. The normal drilling operation of adding a stand to the drill string is one particular circumstance.

An additional example is the measurement of wellbore conditions while the fluid circulation system is not pumping. A specific example of this approach is taught in U.S. Pat. No. 6,296,056 titled "Subsurface Measurement Apparatus, System, and Process for Improved Well Drilling, Control, and Production," assigned to the applicant, but other measurements or tests performed during a break in drilling or in the flow of mud would be recognized by those of skill in the art such as the performance of survey measurements downhole with no drilling or mud flow to interfere with the measurements. In such a circumstance a real-time tester may be mounted on the drill string, but certain tests may not be run during drilling or even during mud flow. If mud-based telemetry is the only alternative, then when drilling is stopped and the tests are run, no data (or if mud is flowing but the bandwidth is inadequate not all data) from the tests is being transmitted. Since the information desired for control of normal drilling processes takes up most if not all of the available bandwidth for mud-based communications, if the information from the test is desired quickly and cannot be completely transmitted (or transmitted at all if the mud is not flowing during the test) then even after completion of the test, there may be a period where mud is flowed through the system without moving forward with the drilling itself, allowing the mud-based transmitter to send back the desired test data at full bandwidth. In such a situation, only after the desired test data is fully transmitted is there bandwidth for the normal MWD data used during drilling itself so that drilling may commence. Hence, not only is the data delayed by waiting for the mud to flow, but then drilling itself is delayed to let the data be transmitted so that the bandwidth is clear for the full MWD information used to control and target the drilling operation.

On the other hand, tubular-based telemetry performs better without the added noise of mud pumping or drilling and is ideally suited for transmitting high bandwidth formation evaluation data, such as might be produced by a tester, while the test is going on. Similarly, the performance of electromagnetic telemetry is not strongly dependent on the presence or absence of flow or drilling, but is somewhat better without drilling and without flow. The use of a tubular-based telemetry device and a mud-based telemetry device both installed on the lower end of the same drill string (also referred to here as being part of the same tool, which may be referred to as the combined telemetry tool) enables use of both channels without need to trip the drill string or drop additional communication devices by wireline or coiled tubing. Hence, the tubular-based telemetry device transmits during testing when the mud-based device could not do so, which may provide the advantages of both earlier access to the information and earlier recommencement of drilling (as there would not be a period of mud-flowing without drilling otherwise needed to communicate the information using the mud-based device). Similar statements apply to the use of an electromagnetic telemetry device and a mud-based telemetry device both installed on the lower end of the same drill string. Alternatively, all three telemetry devices could be installed and both tubular-based telemetry and electromagnetic telemetry could be used while drilling was stopped, providing available bandwidth in both channels.

In the preferred embodiment, while drilling, downhole data is sent up the mud channel using the mud-based telemetry device of the combined telemetry tool. When not drilling, downhole data is sent up the tubular channel using the tubular-based telemetry device of the same tool. In an alternative embodiment, while mud is flowing, downhole data is sent up the mud channel using the mud-based telemetry device of the combined telemetry tool. In an additional variant, downhole data could be sent up the tubular channel using the tubular-based telemetry device of the same tool when mud is not flowing. The use of the separate devices may be strictly either/or (if one is being used then the other is not) which is the more preferred method of this embodiment. Alternatively, the devices may both be operating when not drilling but while mud is still flowing. In theory and as practiced in other alternative methods discussed below, the tubular-based telemetry device could be run all the time, but for this method it specifically is able to provide communication when the mud-based telemetry device is not.

In another alternative embodiment, an electromagnetic telemetry device could replace the tubular-based telemetry device in the various embodiments described above. Similarly, an electromagnetic telemetry device could replace the mud-based telemetry device in the various embodiments described above. In another alternative, an electromagnetic telemetry device could be added to the combined tool and downhole data be sent up the electromagnetic channel either all the time, when drilling, when not drilling, when mud is flowing, or when mud is not flowing, in concert with the usage of the channels of the other devices.

The data being transmitted could comprise any of the various data discussed above and understood by those of skill in the art as desirable to be sent from downhole. It is preferred to send the data as complete packages up a single channel. In this sense, the data would not be broken into two separate components which must be added together or re-encoded to evaluate the data itself. While someone watching a single channel might not see all the data, he would be able to see and interpret the data selected to be sent by that channel (i.e. temperature readings, pressure readings, position readings, or a compilation of all three, but not part of a temperature reading which requires use of the other channel to complete the transmission of the temperature reading). Thus there can be a continuous ability to flow information using each channel in its most reliable and functional mode. By combining into a single tool at the lower end of the drill string, this permits consistent gathering and sending of data (both with mud flowing and without) without need to pull the drill string or drop additional packages.

Main Channel and Check-data Channel Method

A second method attempts to take advantage of the potential greater bandwidth of the tubular channel and/or electromagnetic channel while accounting for their reliability issues. Traditionally use of the tubular channel for telemetry encounters greater difficulty with increasing noise. When using a drill-string, there are fewer operations more noisy than the act of drilling itself. This is particularly disruptive if the data is being compressed, but even if it is not, synchronization can be lost on the tubular channel (a broadband acoustic channel up the drill string) resulting in the loss of data and time while that channel is being recovered. To address this problem, the second method uses the mud channel (a more reliable narrow band channel) to send up selected duplicate data (for example one out of every ten elements of data sent by the broadband channel). Then, if the broadband channel is lost, there may be quicker recovery as the specific frame (or within x (for example 10) of the specific frame) where the failure occurred can be identified and cross-correlated with the acoustic telemetry data. The cross-correlation of the data may be made by use of a data number or time stamp or similar device embedded with the data being transmitted. Again, as with the alternating channels method, it is preferred to send complete data packages up an individual channel rather than separate portions of encoded data. The check-data are separate, albeit duplicate, elements of data which provide information which can then be used to analyze, recover, and potentially salvage the data sent up the tubular channel.

In its preferred embodiment, this method transmits downhole data up one channel (preferably the tubular channel) using an acoustic transducer (preferably a tubular-based telemetry device). Simultaneously, selected elements of the transmitted data are sent in duplicate up a second channel (preferably the mud channel) using an acoustic transducer (preferably a mud-based telemetry device). Both channels are sending complete elements of data independently, and the channels may be read and interpreted separately. The data transmitted by the more reliable but lower bandwidth channel may also be used to provide a quick and steady resource providing a picture of how the data is developing even though it may not provide as much data for analysis. Preferably, the check-data provided by the second channel may also be used to improve recovery when the first channel goes down due to noise, synchronization or other issues. Improving recovery may include more quickly identifying a failure as well as identifying closer to the actual element where failure started.

While the preferred embodiment uses the tubular channel as the primary or broadband channel and the mud channel as the check-data or narrow band channel, many of the same benefits may be realized from any situation where two independent channels of communication are available. For example, although not preferred, where two channels are being used to independently convey different streams of data from downhole, each channel could also carry check-data (requiring lower bandwidth) related to either a data stream or multiple data streams on the other channel. Thus a channel could be carrying a single multiplexed stream of data which is made up by multiplexing a stream of primary data and a stream of check-data. In any event, the data or data streams being communicated could be similar to those described with both the alternating channels method above or the data selection method below.

The use of check-data in this fashion may provide improved ability to recover the synchronization of the signal faster and also identify and recover some of the lost data more effectively. Similar benefits could be obtained by using the electromagnetic channel as the primary channel and the mud-channel as the check-data channel or by using the tubular-based channel as the primary channel and the electromagnetic channel as the check-data channel. Alternatively, all three channels could be employed with some combination from one to all of them conveying one stream of primary data and one stream conveying check data from a different primary data set as discussed with respect to two channels above.

Steering Channel and Log Channel Method

A third method addresses the problems of getting all or as much of the desired data from downhole in the most efficient and reliable manner. A constant challenge in drilling is the ever-increasing sophistication and complexity of the types of data obtainable and the ways of using it to improve drilling and eventual production of hydrocarbons. To improve the bandwidth, multiple independent channels may be used to transmit different streams of data. Preferably, a tubular-based telemetry device may be operated in combination with a mud-based telemetry device in the same tool (i.e. coupled to the same drill string) in jobs involving desired data (typically LWD-type data) that exceeds the capacity or the reliable capacity of the mud-based telemetry device. Alternatively, an electromagnetic telemetry device could be operated in combination with either or both of the described acoustic telemetry devices. To best take advantage of the features of the channels, the most preferred method would incorporate transmitting more critical data (Priority Data) through the more reliable but lower bandwidth channel, while sending more bandwidth intensive data which is less critical (such as LWD formation evaluation data) using the less proven channel operating at higher bandwidths.

The various downhole data streams available for measurement and transmission may be grouped using the following designations. The Priority Data discussed above includes both Steering Data and Safety Data. Safety Data is data used to help provide early detection of potential emergencies in the drilling process. This data may not take up substantial bandwidth, but may provide critical lead-time to avoid large-scale problems which endanger the downhole environment, the drilling equipment, or the people on-site handling the drilling. A number of conditions can develop downhole which will quickly damage the downhole equipment if they are not dealt with quickly. These can range from blowouts which may be monitored through the use of pressure and or temperature readings to issues with the downhole equipment itself. Many of these conditions can be inferred by continuously measuring downhole vibrations along the drill string and in two orthogonal directions in the plane orthogonal to the drill string. When these conditions are detected, it is desirable to transmit a signal to the surface identifying the condition and any relevant parameters. For example, shocks from excessive lateral drill string vibration can quickly destroy the suite of downhole sensors. These are easily detected by examining the outputs of the accelerometers in the plane orthogonal to the drill string. Another condition, known as 'whirl' can result in damage to the drilling equipment and the sensor suite. In addition to a flag warning about the existence of whirl, the frequency of the whirl is also telemetered to the surface. Another condition which can easily damage downhole equipment is what is termed a 'stick/slip' condition (this is also called 'slip/stick'). This is a condition in which the drill string stops rotating for a period of time and then suddenly breaks loose from the forces that were binding it, resulting excessive vibration and potentially decoupling the pipe joints. One set of data which can assist with many of these drill string related safety issues is data from accelerometers placed at or near the drilling collar. Hence Safety Data can comprise pressure readings and accelerometer readings as well as other data related to drilling safety recognized by those of skill in the art.

For the purposes of this disclosure, Directional Steering Data is summarized as information regarding the drill bit and drill string themselves. This comprises information on the orientation of the borehole (more commonly referred to as the inclination and azimuth), the angular orientation of the tool within the borehole (tool face or tool face high side), the position, and the path traveled by the bit (also collectively referred to as location and orientation of the bit). For the purposes of this disclosure, information regarding the environment in which the sensors are located is labeled Formation Steering Data. This information is used to evaluate where the bit is within the formation and to some degree the boundaries of the various formations as the bit approaches them. For the purposes of this disclosure Basic Formation Steering Data comprises pressure and temperature. Some Formation Data discussed below may have various depths of measurements that may be taken where a simple picture may be received by one level of reading with additional data from additional levels of readings providing more substantial information for more substantial analysis. Advanced Formation Steering Data may comprise base level resistivity readings, base level conductivity readings, or even level I nuclear magnetic resonance readings. These types of data are also typically referred to as GeoSteering Data. As a specific example a magnetic resonance imaging logging tool may develop both T1 data and T2 data, where T1 data could be sent in the priority channel as Advanced Formation Steering Data, while the T2 data is transmitted on a secondary channel as Formation Evaluation Data. In some systems there may be bandwidth to provide this Advanced Formation Steering Data in the priority channel, while in others the focus remains on the other Steering Data and Safety Data with either only Basic Formation Steering Data or even no Formation Steering Data at all communicated up the priority channel. Formation Steering Data comprises Basic Formation Steering Data and Advanced Formation Steering Data. Steering Data comprises Formation Steering Data and Directional Steering Data. Priority Data comprises Safety Data and Steering Data.

In addition to data used for steering the bit itself, data may also be used to evaluate the formation for future production and for evaluation of the drilling efforts up to the point of measurement. This may be done using formation testers, including real-time testers, typically during pauses in drilling. This may also be done using sensor packages active during drilling itself. This is referred to herein collectively as Formation Evaluation data and can include information directly or indirectly about the density or porosity of the formation and the composition, pressure, and moveability of formation fluids, as well as data regarding the Formation's projected productivity such as hydrocarbon flow and recovery. Specific examples may include various types of natural gamma radiation readings, resistivity readings, neutron porosity readings, density readings, compressional and shear wave readings, magnetic resonance spin-echo readings, pore pressure readings, and magnetic resonance imaging logging readings. Formation Evaluation data may also include the various other types of collections of data recognized by those of skill in the art. The data density is typically greater in such cases, requiring a higher bandwidth to transmit, but is less immediately time critical. Much of this data has traditionally been stored in downhole memory associated with the attached sensors and retrieved whenever the drill string is tripped, sometimes calling for a special effort to pull the drill string in order to obtain these logs. A lower bandwidth version of these logs is referred to as quality of log data which represents a sampling of the data going into the logs or other data which may be used to quickly evaluate to ensure that good logs are being obtained. If the quality of log data demonstrates a problem, then this provides advance notice that efforts should be taken to fix the problem, which otherwise would go unnoticed until the drill string was pulled and the logs retrieved, potentially wasting time and effort and losing the opportunity for good log data unnecessarily. Where possible the Formation Evaluation data may be transmitted in a more complete form, such as during breaks in drilling, representing the bulk of the stored or gathered data rather than the sampling provided by Quality of Log data.

The sending or transmitting of one of these defined classes of data means the sending of data falling within the class and does not necessarily require sending all of the types of data which may fall within the class. As with the other methods discussed, it is preferred to send data elements as complete packages within one channel which may be read and interpreted without reference to another channel of communication.

In its most preferred embodiment, a first telemetry transmitter (preferably an acoustic transducer, more preferably a mud-based acoustic telemetry device, but alternatively an electromagnetic telemetry device) is used to transmit Priority data and Quality of Log data up a first channel (the priority channel which is preferably an acoustic channel, more preferably the mud channel, but alternatively the electromagnetic channel) while a second telemetry transmitter (preferably an acoustic transducer, more preferably a tubular-based acoustic telemetry device, but alternatively an electromagnetic telemetry device) also attached to the drill string is used to transmit the bulk of the Formation Evaluation data up a second channel (the secondary channel or log channel or evaluation channel which is preferably an acoustic channel, more preferably the tubular channel, but alternatively the electromagnetic channel). In another embodiment, a first telemetry transmitter is used to transmit Steering data and Quality of Log data up a first channel (preferably an acoustic channel, more preferably the mud channel, but alternatively the electromagnetic channel) while a second acoustic transmitter also attached to the drill string is used to transmit the bulk of the Formation Evaluation data up a second channel (preferably an acoustic channel, more preferably the tubular channel, but alternatively the electromagnetic channel). In a noisy environment, particularly during drilling, the secondary channel may have varying bandwidth (particularly where the secondary channel is the tubular channel) and may not accommodate complete real-time transmission of all logs of all Formation Evaluation data. Nevertheless, in the most preferred embodiment, the majority of (at least 50%, preferably at least 70%, and most preferably at least 90%) the Formation Evaluation data being collected or the majority of each of selected streams of Formation Evaluation data being collected will be sent up the secondary channel. As briefly addressed in alternative above, the electromagnetic channel may be used to replace either the role of the mud channel as the priority channel or the role of the tubular channel as the secondary channel. In another alternative embodiment, the electromagnetic channel could be run at the same time as both acoustic channels where the electromagnetic channel acts as an additional secondary channel. In this event the majority of each of selected streams of Formation Evaluation data could be sent up one secondary channel while the majority of each of a different set of selected streams of Formation Evaluation data could be sent up the other secondary channel.

A number of alternative methods may also be employed depending on the scope of the desired data, the amount of noise, the complexity of the environment, and other optimization features. For example, a mud-based telemetry device or an electromagnetic telemetry device could be used to transmit Directional Steering data, Basic Formation data, or Advanced Formation data, individually or in combination. Similarly, a tubular-based telemetry device or an electromagnetic telemetry device could be used to transmit quality of log data, particularly where a substantial number of logs are being run during a particular operation. Tester data could specifically be transmitted using the tubular channel or using the electromagnetic channel. In some occasions, particularly with simple logs, some complete formation evaluation streams could be transmitted using the mud channel, either alone or in combination with Steering data. In any event, two or even three channels are preferably used simultaneously to communicate distinct and independent data streams from the lower end of the wellbore.

While preferred embodiments of this invention have been shown and described, modifications thereof can be made by one skilled in the art without departing from the spirit or teaching of this invention. The embodiments described herein are exemplary only and are not limiting. Many variations and modifications of the system and apparatus are possible and are within the scope of the invention. Accordingly, the scope of protection is not limited to the embodiments described herein, but is only limited by the claims which follow, the scope of which shall include all equivalents of the subject matter of the claims.

What is claimed is:

1. A method for communicating data in a wellbore having a drill string, comprising:

using a first telemetry transmitter coupled to the drill string to transmit a first data stream through a first communications channel;

using a second telemetry transmitter coupled to the drill string to transmit a second data stream through a second communications channel;

wherein said first data stream and said second data stream are each independently interpretable without reference to data provided up the other of the communications channels; further comprising;

using a third telemetry transmitter coupled to the drill string to transmit a third data stream through a third communications channel;

wherein said third data stream is independently interpretable without reference to data provided up the first and the second communications channels.

2. The method of claim 1, wherein the first telemetry transmitter and the second telemetry transmitter transmit their data simultaneously.

3. The method of claim 1, wherein the first telemetry transmitter and the second telemetry transmitter do not transmit data at the same time.

4. The method of claim 1, wherein the first telemetry transmitter and the second telemetry transmitter and the third telemetry transmitter transmit their data simultaneously.

5. The method of claim 1, wherein the first telemetry transmitter is a mud-based acoustic telemetry device and the second telemetry transmitter is a tubular-based acoustic telemetry device.

6. The method of claim 1 wherein the first telemetry transmitter is a mud-based acoustic telemetry device and the second telemetry transmitter is an electromagnetic telemetry device.

7. The method of claim 1 wherein the first telemetry transmitter is an electromagnetic telemetry device and the second telemetry transmitter is a tubular-based acoustic telemetry device.

8. The method of claim 1, wherein the first telemetry transmitter is a mud-based acoustic telemetry device;

the second telemetry transmitter is a tubular-based acoustic telemetry device; and the third telemetry transmitter is an electromagnetic telemetry device.

9. The method of claim 1, wherein the second telemetry transmitter and the third telemetry transmitter transmit their data simultaneously, and wherein the first telemetry transmitter does not transmit data at the same time as the second telemetry transmitter and the third telemetry transmitters.

10. The method of claim 9, wherein the first telemetry transmitter is a mud-based acoustic telemetry device;

the second telemetry transmitter is a tubular-based acoustic telemetry device; and the third telemetry transmitter is an electromagnetic telemetry device.

11. A method for communicating data in a wellbore wherein the earth forms an electromagnetic communications channel and having a drill string forming a tubular communications channel and through which drilling mud flows during drilling operations forming a mud communications channel, comprising:

using a mud-based acoustic telemetry device coupled to the drill string to transmit data through the mud channel when mud is flowing;

using a tubular-based acoustic telemetry device coupled to the drill string to transmit data through the tubular channel when active drilling is not occurring; and using an electromagnetic telemetry device coupled to the drill string to transmit data through the electromagnetic channel when active drilling is not occurring.

12. The method of claim 11, wherein the mud-based telemetry device is used only when active drilling is occurring.

13. The method of claim 11, wherein the tubular-based acoustic telemetry device is used only when active drilling is not occurring.

14. The method of claim 11, wherein the electromagnetic telemetry device and the tubular-based acoustic telemetry device are used only when mud is not flowing.

15. The method of claim 11, wherein at any one time the data is communicated using either only the mud-based acoustic telemetry device or only at least one of the tubular-based acoustic telemetry device and the electromagnetic telemetry device.

16. The method of claim 15, wherein the data alternates between communication using the mud-based telemetry device through the mud channel when mud is flowing and communication using at least one of the electromagnetic telemetry device through the electromagnetic channel and the tubular-based telemetry device through the tubular channel when mud is not flowing.

17. The method of claim 15, wherein the data alternates between communication using the mud-based telemetry device through the mud channel when mud is flowing and communication using both of the electromagnetic telemetry device through the electromagnetic channel and the tubular-based telemetry device through the tubular channel when mud is not flowing.

18. The method of claim 15, wherein the data alternates between communication using the mud-based telemetry device through the mud channel when active drilling is occurring and communication using at least one of the electromagnetic telemetry device through the electromagnetic channel and the tubular-based telemetry device through the tubular channel when active drilling is not occurring.

19. The method of claim 15, wherein the data alternates between communication using the mud-based telemetry device through the mud channel when active drilling is occurring and communication using both of the electromagnetic telemetry device through the electromagnetic channel and the tubular-based telemetry device through the tubular channel when active drilling is not occurring.

20. A method for communicating data in a wellbore having a drill string through which drilling mud flows during drilling operations, comprising:

using a first telemetry transmitter coupled to the drill string to transmit a first data stream through a first communications channel;

using a second telemetry transmitter coupled to the drill string to transmit a second data stream through a second communications channel;

wherein said second data stream comprises selected duplicated elements of said first data stream and wherein each data stream and such elements are each independently interpretable without reference to data provided up the other of the communications channels.

21. The method of claim 20, wherein the method is for communicating data in a wellbore having a drill string forming a tubular communications channel and through which drilling mud flows during drilling operations and wherein the earth forms an electromagnetic communications channel, wherein:

the first telemetry transmitter is an electromagnetic telemetry device and the first communications channel is the electromagnetic channel; and the second telemetry transmitter is a tubular-based telemetry device and the second communications channel is the tubular channel.

22. The method of claim 20, wherein the method is for communicating data in a wellbore having a drill string through which drilling mud flows during drilling operations forming a mud-based communications channel and wherein the earth forms an electromagnetic communications channel, wherein:

the first telemetry transmitter is a mud-based acoustic telemetry device and the first communications channel is the mud channel; and the second telemetry transmitter is an electromagnetic telemetry device and the first communications channel is the electromagnetic channel.

23. The method of claim 20, wherein the first stream of data comprises the majority of the formation evaluation data being collected.

24. The method of claim 20, wherein the selected duplicated elements of said first data stream comprise a sampling of elements of said first data stream.

25. The method of claim 20, wherein the selected duplicated elements of said first data stream comprise a duplicate of every tenth element of said first data stream.

26. The method of claim 20, wherein said first data stream comprising at least two multiplexed data streams;

wherein said second data stream comprises at least two multiplexed data streams;

wherein a first of the multiplexed streams of the second data stream comprises selected duplicated elements of a first of the multiplexed streams of the first data stream; and wherein a second of the multiplexed streams of the first data stream comprises selected duplicated elements of a second of the multiplexed streams of the second data stream.

27. The method of claim 20, wherein the method is for communicating data in a wellbore having a drill string forming a tubular communications channel and through which drilling mud flows during drilling operations forming a mud communications channel, wherein:

the first telemetry transmitter is a first acoustic transducer; and the second telemetry transmitter is a second acoustic transducer.

28. The method of claim 27, wherein the first acoustic transducer is a tubular-based telemetry device and the first communications channel is the tubular channel; and wherein the second acoustic transducer is a mud-baaed telemetry device and the second communications channel is the mud channel.

29. The method of claim 28, wherein the data stream communicated up the mud channel comprises selected duplicated elements of said first data stream and steering data.

30. The method of claim 28, wherein the data stream communicated up the mud channel comprises selected duplicated elements of said first data stream and safety data.

31. The method of claim 28, wherein the first stream of data comprises the majority of a selected stream of formation evaluation data being collected.

32. The method of claim 28, wherein the data stream communicated up the mud channel comprises selected duplicated elements of said first data stream and priority data.

33. The method of claim 32, wherein the sampling of elements is one out of every ten elements.

34. A method for communicating data in a wellbore having a drill string forming a tubular communications channel and through which drilling mud flows during drilling operations forming a mud communications channel and wherein the earth forms an electromagnetic communications channel, comprising:

using a first telemetry transmitter coupled to the drill string to transmit a first collection of data through a priority communications channel, wherein the first collection of data comprises priority data;

using a second telemetry transmitter coupled to the drill string to transmit a second collection of data through a secondary communications channel, wherein the second collection of data comprises formation evaluation data;

wherein each collection of data is independently interpretable without reference to data provided up the other of the communications channels;

further comprising:

using a third telemetry transmitter coupled to the drill string to transmit a third collection of data through a tertiary communications channel, wherein the third collection of data comprises formation evaluation data; and wherein the third collection of data is independently interpretable without reference to data provided up either of the other communications channels.

35. The method of claim 34, wherein:

the first telemetry transmitter is an electromagnetic telemetry device and the priority communications channel is the electromagnetic channel; and the second telemetry transmitter is a tubular-based telemetry device and the secondary communications channel is the tubular channel.

36. The method of claim 34, wherein:

the first telemetry transmitter is a mud-based telemetry device and the priority communications channel is the mud channel; and the second telemetry transmitter is an electromagnetic telemetry device and the secondary communications channel is the electromagnetic channel.

37. The method of claim 34, wherein the first collection of data communicated through the priority channel comprises safety data.

38. The method of claim 34, wherein the first collection of data communicated through the priority channel further comprises quality of log data.

39. The method of claim 34, wherein the formation evaluation data communicated through the secondary channel comprises formation tester data.

40. The method of claim 34, wherein the formation evaluation data communicated through the tubular channel comprises the majority of a selected stream of formation evaluation data being collected.

41. The method of claim 34, wherein the formation evaluation data communicated through the tubular channel comprises the majority of the formation evaluation data being collected.

42. The method of claim 34, wherein the first collection of data communicated through the priority channel comprises the majority of a selected stream of formation evaluation data being collected.

43. The method of claim 34, wherein the data communicated through the secondary channel consists essentially of formation evaluation data.

44. The method of claim 34, wherein the data communicated through the priority channel consists essentially of priority data and quality of log data.

45. The method of claim 34, wherein the data communicated through the priority channel consists essentially of priority data.

46. The method of claim 34, wherein the first collection of data communicated through the priority channel comprises steering data.

47. The method of claim 46, wherein the steering data communicated through the priority channel comprises directional steering data.

48. The method of claim 46, wherein the steering data communicated through the priority channel comprises formation steering data.

49. The method of claim 34, wherein:

the first telemetry transmitter is a first acoustic transducer; and the second telemetry transmitter is a second acoustic transducer.

50. The method of claim 49, wherein:

the first acoustic transducer is a mud-based telemetry device and the priority communications channel is the mud channel; and wherein the second acoustic transducer is a tubular-based telemetry device and the secondary communications channel is the tubular channel.

51. The method of claim 50, wherein the mud-based telemetry device is a mud pulser.

52. The method of claim 50, wherein the mud-based telemetry device is a mud siren.

53. The method at claim 50, wherein the tubular-based telemetry device comprises a piezoelectric stack.

54. The method of claim 50, wherein the tubular-based telemetry device comprises a magnetostrictive element.

* * * * *